US009682487B1

(12) United States Patent
Nykoluk

(10) Patent No.: US 9,682,487 B1
(45) Date of Patent: Jun. 20, 2017

(54) FOLDING KNIFE WITH THUMB BRIDGE

(71) Applicant: Noble Rider, LLC, Modesto, CA (US)

(72) Inventor: Cory Nykoluk, Orange, CA (US)

(73) Assignee: First Tactical LLC, Modesto, CA (US)

( * ) Notice: Subject to any disclaimer, the term of this patent is extended or adjusted under 35 U.S.C. 154(b) by 0 days.

(21) Appl. No.: 14/852,348

(22) Filed: Sep. 11, 2015

(51) Int. Cl.
*B26B 1/02* (2006.01)
*B26B 9/00* (2006.01)

(52) U.S. Cl.
CPC . *B26B 1/02* (2013.01); *B26B 9/00* (2013.01)

(58) Field of Classification Search
CPC ..... B26B 1/02; B26B 9/00
USPC ..... 30/155–161, 295
See application file for complete search history.

(56) References Cited

U.S. PATENT DOCUMENTS 5,009,008 A * 4/1991 Yablonovitch ..... B26B 1/02 30/158
5,095,624 A * 3/1992 Ennis ..... B26B 1/04 30/159
5,699,615 A * 12/1997 Chen ..... B26B 1/046 30/160
6,523,265 B2 * 2/2003 Eickhorn ..... B26B 1/048 30/155
6,834,432 B1 * 12/2004 Taylor, Jr. ..... B26B 1/046 30/160
7,036,229 B1 * 5/2006 Demko ..... B26B 1/02 30/160
7,284,329 B1 * 10/2007 King ..... B26B 1/046 30/160
7,543,386 B2 * 6/2009 Sullivan ..... B26B 1/046 30/160
7,681,316 B2 * 3/2010 Hawk ..... B26B 1/04 30/155
7,827,697 B2 * 11/2010 Lake ..... B26B 1/044 30/159
8,752,298 B2 * 6/2014 Collins ..... B26B 1/044 30/160
2015/0251324 A1 * 9/2015 Tkachenko ..... B26B 1/02 30/155

* cited by examiner

*Primary Examiner* — Hwei C Payer
(74) *Attorney, Agent, or Firm* — Thomas M. Freiburger

(57) ABSTRACT

A foldable knife, which can be a pocket knife, has a spine with a generally arcuate cutout or indentation, over which is secured a thumb bridge, leaving the indentation open between the spine and the bridge. To open the blade the user extends a thumb below the thumb bridge to pivot the blade out of a slot in the housing. With the blade fully opened, the thumb bridge provides an ergonomic engagement point for the thumb of the user when gripping the handle.

7 Claims, 3 Drawing Sheets

FOLDING KNIFE WITH THUMB BRIDGE

BACKGROUND OF THE INVENTION

This invention concerns knives as used for hunting and fishing or for self defense, and more particularly, a knife with a folding blade that can be stored in a slot of the handle when not in use.

Most knives, particularly folding-blade knives, include a thumb hole in the knife blade or a thumb stud or thumb plate secured to the spine (back edge) of the knife. The thumb hole assists the user in pivoting the blade out of the handle. A thumb stud or thumb plate will also serve this purpose and in some cases can provide an engagement place for the thumb when the blade is opened. Spyderco (of Golden, Colo.) has marketed folding knives with both a thumb hole and a plate, and with a friction surface on top of the plate for thumb engagement when using the opened knife. These various features are effective in assisting the user to open the knife, which can sometimes be cumbersome, and they generally do not permit opening of the knife using a gloved hand.

SUMMARY OF THE INVENTION

The invention described herein is a folding-blade knife having a feature that both assists in opening of the blade and in gripping of the knife in use. A foldable knife, which can be a pocket knife, has a spine with a generally arcuate cutout or indentation, over which is secured a thumb bridge, leaving the indentation open between the spine and the bridge. To open the blade the user extends a thumb below the thumb bridge to pivot the blade out of a slot in the housing. The bridge and the blade recess cooperate to provide for easy and comfortable opening of the knife. With the blade fully opened, the thumb bridge provides an ergonomic engagement point for the thumb of the user when gripping the handle.

The thumb bridge is secured to the knife's spine, forward and aft of the arcuate cutout or indentation in the spine. This can be via slots formed in the bottom sides of the bridge at fore and aft ends, the slots engaged closely over the spine and with fasteners securing the bridge in place. Fasteners can include rivets through the bridge and the knife's spine at the slats, threaded studs extending out from the spine and through the bridge, or machine screws through the bridge at both ends, engaged in tapped holes in the spine.

The thumb bridge with the downwardly curving indentation or cutout below serves dual purposes: it provides an opening or cavity feature to easily control the knife blade, as well as providing a prominent tactile gripping element for a gloved hand; and with the blade fully opened, the thumb bridge provides a convenient and useful thumb engagement pad when the user's fingers are gripped around the knife's handle. The thumb bridge establishes an ergonomic and natural grip for the knife when in use.

It is among the objects of this invention to improve the operation of a folding-blade knife with an ergonomic feature on the blade that aids the user in easily opening the knife, even with a gloved hand, and which provides a comfortable and ergonomic pressure pad for a holder's thumb when using the knife. These and other objects, advantages and features of the invention will be apparent from the following description of a preferred embodiment, considered along with the accompanying drawings.

DESCRIPTION OF PREFERRED EMBODIMENTS

Figure 1:
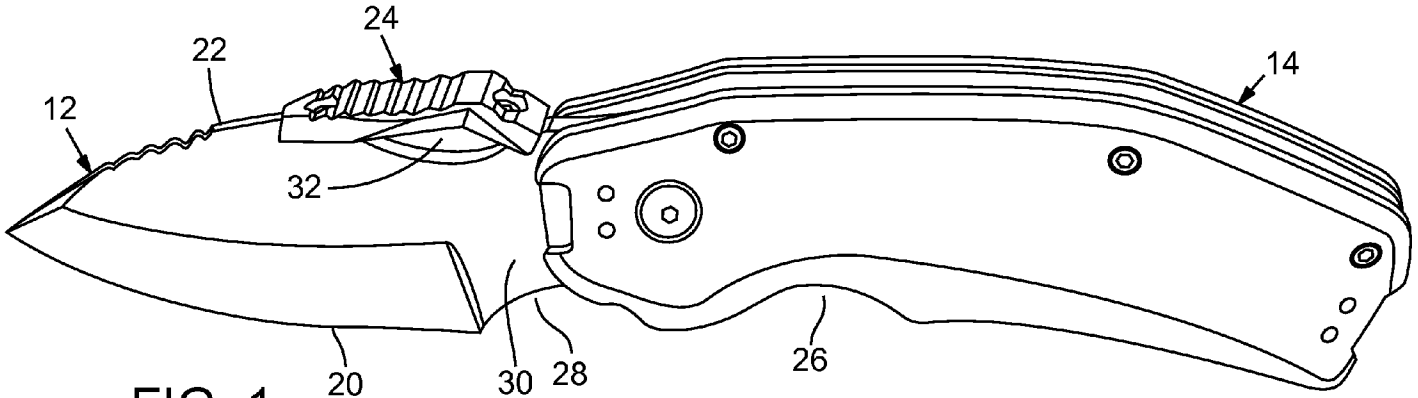
FIG. 1 is a perspective view showing the knife of the invention with opened blade.

FIG. 1 shows a folding knife 10 having the features of the invention. The particular knife is shown as a spear tip knife but the invention encompasses nearly all types of folding knives. A blade 12 is pivotally connected in a handle 14, essentially in the usual way, with a knife storage slot 16 in the handle to receive the blade when folded to a storage position. The handle 14 on this knife is shown with a spring clip 18 to engage a pocket or the edge of another garment, backpack, etc. The blade 12 has a cutting edge 20 and a spine (thick, unsharpened back edge) 22. A thumb bridge 24 is secured to the spine, being a separate, attached structure and bridging over a cutout or indentation 32 in the back edge or spine 22, this feature being better seen in other figures described below. In FIG. 1 a finger grip for the user's hand is also illustrated, with two finger depressions or recesses, a rear one seen at 26 in the handle and a forward one 28 being formed partly by the handle and partly in the choil 30 of the blade.

Figure 2:
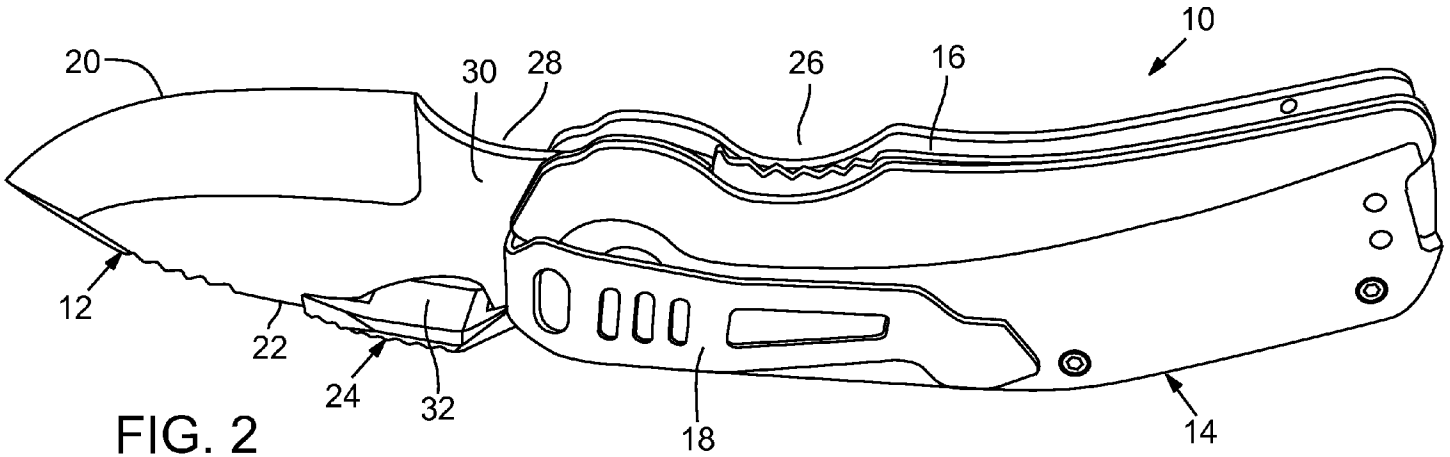
FIG. 2 is another perspective view of the knife, from a different angle.

FIG. 2 shows the knife 10, again with opened blade, from a different perspective. The thumb bridge 24 is seen bridging over the indentation or generally arcuate depression 32 in the blade's spine. This indentation cutout is open at the upper side of the spine, not a complete circular hole in the blade, closed at the top of the blade only by the thumb bridge. This provides both an opening and a grippable edge on each side of the spine, to enable efficient opening of the blade from a closed position.

Figure 3:
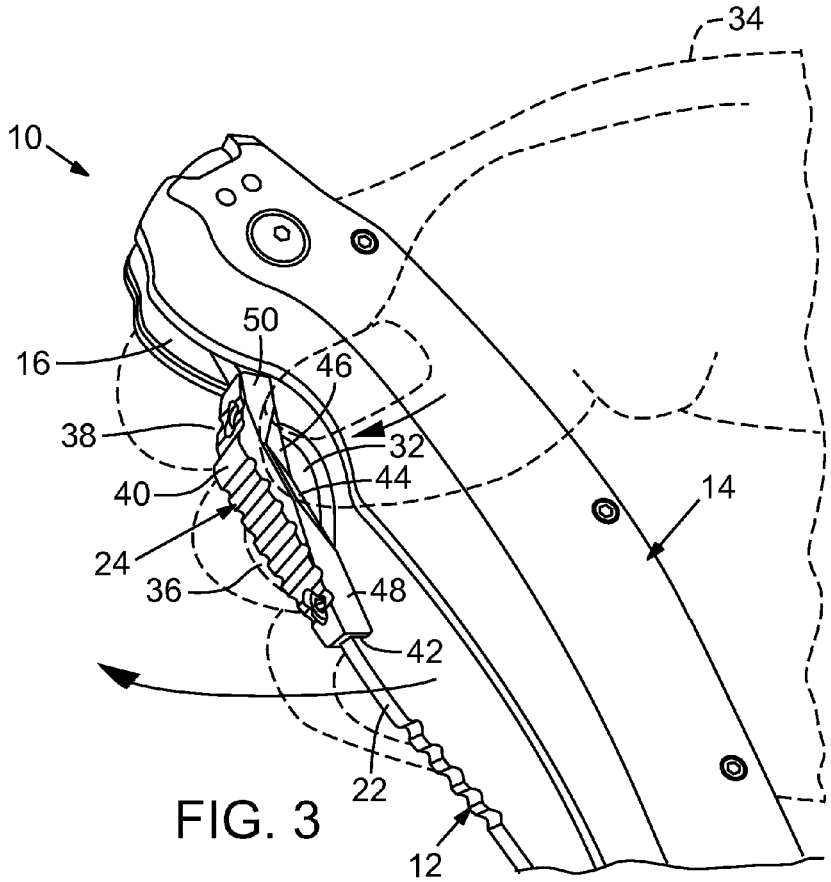
FIG. 3 is a perspective view showing a user's hand engaging a thumb bridge to open the knife blade.

FIG. 3 shows an example of use of the thumb bridge 24. A user's hand 34 is shown gripping the knife handle 14. The user's hand holds the knife with two or three fingers at one side of the handle and with a thumb or forefinger, or both, engaging edges of the thumb bridge, from below. The thumb or the finger can be used to push the thumb bridge 24 outwardly, swinging the knife blade out of the storage slot 16, and at least partly toward the opened position. As stated above, this can also be done with a gloved hand. Note that the blade can also be pulled out with the hand at the opposite position (not shown), gripping the thumb bridge from what would be the lower left in FIG. 3 with one or two fingers (the term "finger" as used herein is intended to include the thumb).

Figure 4:
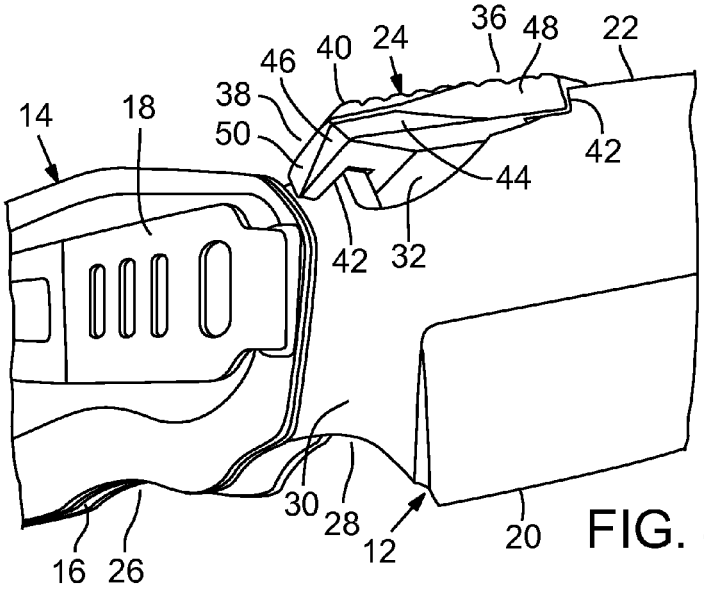
FIG. 4 is a detail view showing the thumb bridge, a central feature of the knife.
Figure 5:
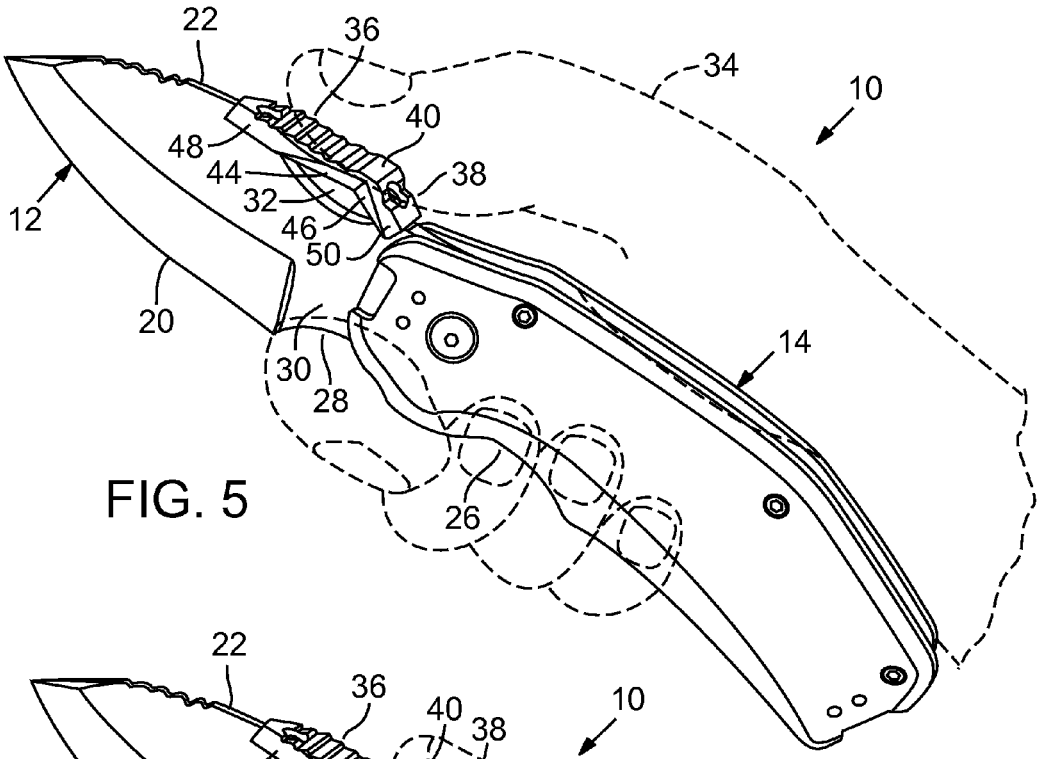
FIG. 5 is another view showing a detail of the thumb bridge.
Figure 6:
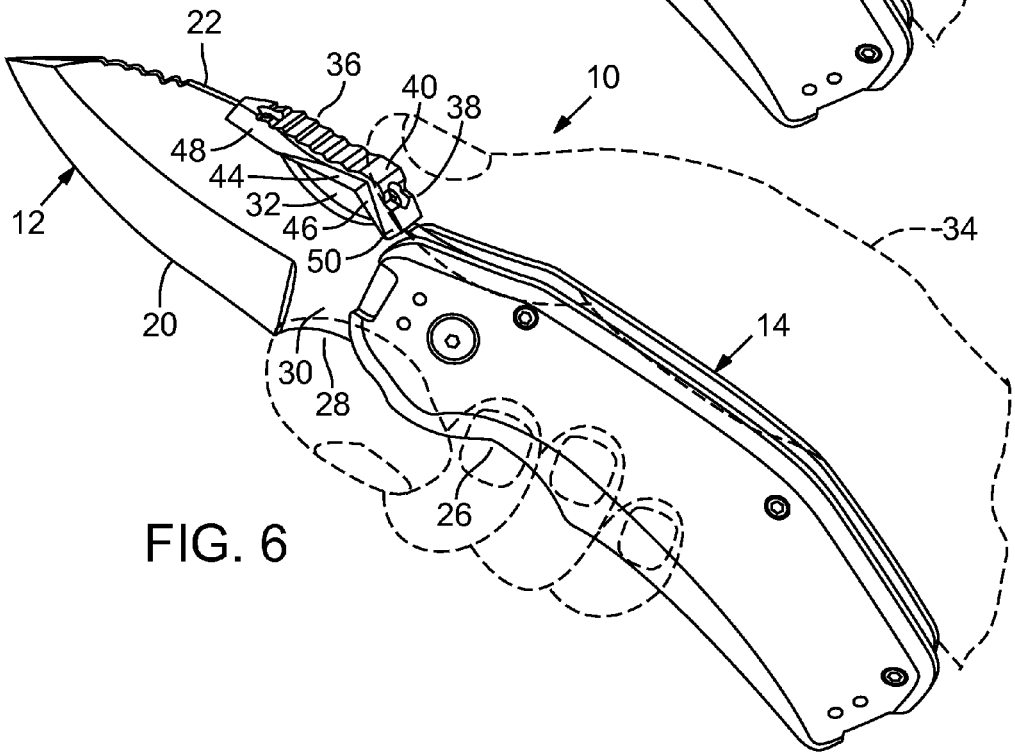
FIG. 6 is a perspective view showing a user's hand on the open-blade knife.

FIGS. 4-6 show the thumb bridge 24 in greater detail. These views reveal one preferred shape of the thumb bridge, preferably an angled metal member with a generally planar forward section 36 and a downwardly turned rear section 38, forming an outwardly directed apex 40 above the blade's spine cutout or indentation 32, which preferably is generally arcuate as shown. The forward portion 36 of the thumb bridge preferably is generally aligned with the upper surface of the knife housing and blade with the blade opened, or, in the case of the knife configuration shown in these views, generally following a curving contour along the top of the opened knife. Note that the thumb bridge can be of different shapes as desired.

FIGS. 3, 4 and 6 show that the fore and aft lower sides of the thumb bridge preferably are slotted to receive the blade's spine or back edge closely in the slots 42. The thumb bridge is fixed to the spine via the slots and a fastener at each of fore and aft ends of the bridge 24, near the front of the forward section 36 and in the rear section 38. These fasteners can be threaded integral studs extending up from the spine and through bores in the bridge 24, with nuts screwed on the ends of the studs, or they can be threaded bores in the blade spine itself, with machine screws secured in these bores and retaining the bridge in place or any other effective securement means.

The angle made by the thumb bridge at the apex 40 in the illustrated embodiment is approximately 15° to 25°. Importantly, the rear portion 38 provides for ergonomic thumb engagement with the open-bladed knife, as seen in FIG. 6. A textured or ridged surface can be formed at this thumb pad position if desired, and such a surface is also shown on the forward portion, for a different hand position to exert pressure of the blade at a somewhat different angle.

Another feature of the thumb bridge is its shape at the underside. FIGS. 3 and 4 illustrate that the bridge at its underside has an upward taper 44 at the forward section and 46 at the rear section, for comfortable engagement by a thumb or finger. Also, the bridge also preferably tapers to a narrower connection as seen at 48 in FIGS. 3-6, as well as tapering at 50 in the rear section. The thumb bridge preferably is widest where needed, over the indentation or opening 32 where the bridge will be engaged by the user's thumb or finger.

The knife handle 14 can be molded nylon, G-10 or metal. The bridge can be formed of steel (cast or forged), molded plastic or composite. For connection to the blade spine, the bridge can be machine-screwed, press fit or riveted. Although the illustrated form of the bridge is a preferred embodiment, the bridge can be in other shapes such as curved, arcuate or generally straight.

On a knife 10 with a handle of about 10-11 cm in length and about 1.5 cm in width (or about 1.4 to 1.6 cm), the thumb bridge can be about 1.1-1.3 cm in width at its widest point (centrally). It can be attached to a blade with spline (edge) of about 3 to 3. 5 mm. Preferably the cutout 32 and the thumb bridge 24 are located in the back third of the blade's spine.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A folding knife with a handle and a blade with a cutting edge secured by a pivot connection to the handle so as to be extended by swinging out of a blade-storing slot in the handle, comprising:

a spine or back edge of the knife blade having a cutout or indentation, and including a thumb bridge comprising a separate structure secured to the spine of the blade and extending across the indentation, leaving the cutout or indentation open between the spine and the thumb bridge, the thumb bridge being secured fixedly and immovably to the spine at positions forward and aft of the cutout or indentation, the thumb bridge having a width greater than the thickness of the spine to which it is secured and having a thumb-engaging surface at a position where a user's thumb will engage when the user grips the knife when opened with the blade extended, with fingers of the user on a grip of the handle, and the thumb bridge, when the blade is folded into the slot of the handle, being positioned such that the user with the handle in hand can push the blade to pivotally extend the blade out of the slot of the handle by engaging one or more fingers against the thumb bridge at the cutout and the thumb bridge further including a forward portion that tapers in width to a narrower forward end adjacent to said position forward of the cutout or indentation where the thumb bridge is secured to the spin.

2. The knife of claim 1, wherein the cutout or indentation in the knife's spine is generally arcuate.

3. The knife of claim 1, wherein the knife handle has a width of between 1.4 and 1.6 cm, and the thumb bridge has a width of between 1.1 and 1.3 cm.

4. The knife of claim 1, wherein the thumb bridge is located in a back third of the blade spine.

5. A folding knife with a handle and a blade with a cutting edge secured by a pivot connection to the handle so as to be extended by swinging out of a blade-storing slot in the handle, comprising:

a spine or back edge of the knife blade having a cutout or indentation, and including a thumb bridge comprising a separate structure secured to the spine of the blade and extending across the indentation, leaving the cutout or indentation open between the spine and the thumb bridge, the thumb bridge being secured to the spine at positions forward and aft of the cutout or indentation, the thumb bridge having a width greater than the thickness of the spine to which it is secured and having a thumb-engaging surface at a position where a user's thumb will engage when the user grips the knife when opened with the blade extended, with fingers of the users on a grip of the handle, and the thumb bridge, when the blade is folded into the slot of the handle, being positioned such that the user with the handle in hand can push the blade to pivotally extend the blade out of the slot of the handle by engaging one or more fingers against the thumb bridge at the cutout, and wherein the thumb bridge comprises an angled metal piece having a width no wider than the knife handle and including a forward section which is generally planar and a rear section which is generally planar but angled relative to the forward section thus forming an apex that extends outwardly away from the spine, between the forward and rear sections.

6. The knife of claim 5, wherein at least a portion of the thumb bridge has a surface with ridges for frictional engagement with a user's finger.

7. A folding knife with a handle and a blade with a cutting edge secured by a pivot connection to the handle so as to be extended by swinging out of a blade-storing slot in the handle, comprising:

a spine or back edge of the knife blade having a cutout or indentation, and including a thumb bridge comprising a separate structure secured to the spine of the blade and extending across the indentation, leaving the cutout or indentation open between the spine and the thumb bridge, the thumb bridge being secured to the spine at positions forward and aft of the cutout or indentation, the thumb bridge having a width greater than the thickness of the spine to which it is secured and having a thumb-engaging surface at a position where a user's thumb will engage when the user grips the knife when opened with the blade extended, with fingers of the user on a grip of the handle, and the thumb bridge, when the blade is folded into the slot of the handle, being positioned such that the user with the handle in hand can push the blade to pivotally extend the blade out of the slot of the handle by engaging one or more fingers against the thumb bridge at the cutout, and wherein the thumb bridge is secured to the spine of the knife by slots in a lower forward end and a lower rear end of the thumb bridge, the slots of the thumb bridge fitting closely over the spine forward and rear of the spine's indentation, and with fasteners engaged between the thumb bridge and the spine.

* * * * *